United States Patent [19]

Carr et al.

[11] Patent Number: 4,631,767

[45] Date of Patent: Dec. 30, 1986

[54] AIR FLOTATION MATTRESS

[75] Inventors: Myra J. Carr; Frances H. Brosig, both of Shawnee Mission, Kans.; Robert G. Gottlieb, Houston, Tex.

[73] Assignee: KCJ Corporation, Shawnee Mission, Kans.

[21] Appl. No.: 673,575

[22] Filed: Nov. 21, 1984

[51] Int. Cl.[4] ..... A47C 27/08

[52] U.S. Cl. ..... 5/449; 5/453; 5/455; 5/457

[58] Field of Search ..... 5/449, 450, 453, 455–457

[56] References Cited

U.S. PATENT DOCUMENTS

| | | | |
|---|---|---|---|
| 1,408,871 | 3/1922 | Enos . | |
| 2,549,597 | 4/1951 | Harris et al. | 5/457 |
| 3,205,514 | 9/1965 | Reynolds et al. . | |
| 3,286,284 | 11/1966 | Klogether . | |
| 3,340,551 | 9/1967 | Hopkins . | |
| 3,354,476 | 11/1967 | Scales et al. . | |
| 3,653,083 | 4/1972 | Lapidus . | |
| 3,822,425 | 7/1974 | Scales . | |
| 3,849,813 | 11/1974 | Nellson . | |
| 3,959,035 | 6/1976 | Nos | 5/455 |
| 4,149,285 | 4/1979 | Stanton | 5/453 |
| 4,225,989 | 10/1980 | Corbett et al. . | |
| 4,267,611 | 5/1981 | Aguinick . | |
| 4,347,633 | 9/1982 | Gammons et al. | 5/453 |
| 4,391,009 | 7/1983 | Schild et al. | 5/453 |
| 4,391,010 | 7/1983 | Kronman . | |
| 4,425,676 | 1/1984 | Crane | 5/450 |

*Primary Examiner*—Thomas J. Holko
*Assistant Examiner*—Michael F. Trettel
*Attorney, Agent, or Firm*—Schmidt, Johnson, Hovey & Williams

[57] ABSTRACT

A ventilating, patient-supporting mattress apparatus is provided which provides full patient support solely by means of pressurized airflow and with the complete absence of internal solid support structure which can cause pressure sores or the like on a patient's skin. In preferred forms, the mattress apparatus includes a lower inflatable chamber having an air-pervious upper wall, together with a secondary, air-pervious, overlying suede or un-buffed leather wall secured to the chamber to define an upper inflatable compartment between the upper and secondary walls. A fan assembly is operatively coupled with the lower chamber to supply pressurized air thereto; such air is passed into the chamber and thence through the upper and secondary walls in a throttled fashion so as to inflate the mattress. Continuous airflow through the mattress also provides soothing ventilation for sensitive skin. Use of suede or unbuffed leather for the secondary wall creates a smooth, comfortable surface for the patient which facilitates moisture dissipation from the patient's skin, acts as an insulator, avoids abrasion, and is a totally natural material.

9 Claims, 3 Drawing Figures

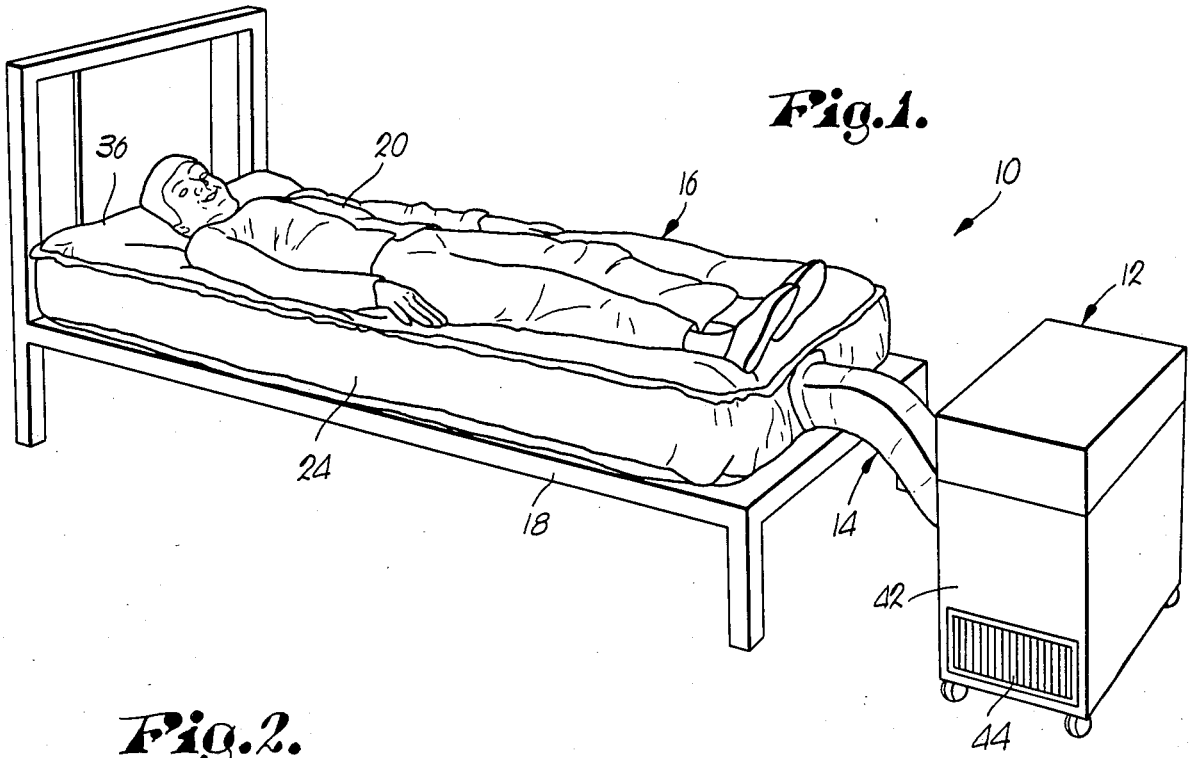
Fig.1.
Fig.2.
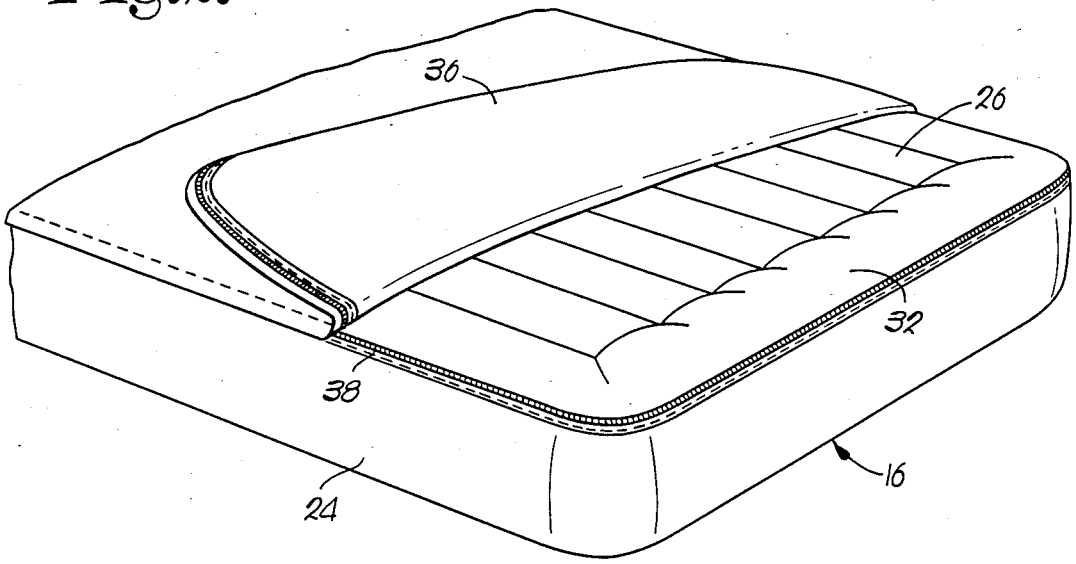
Fig.3.
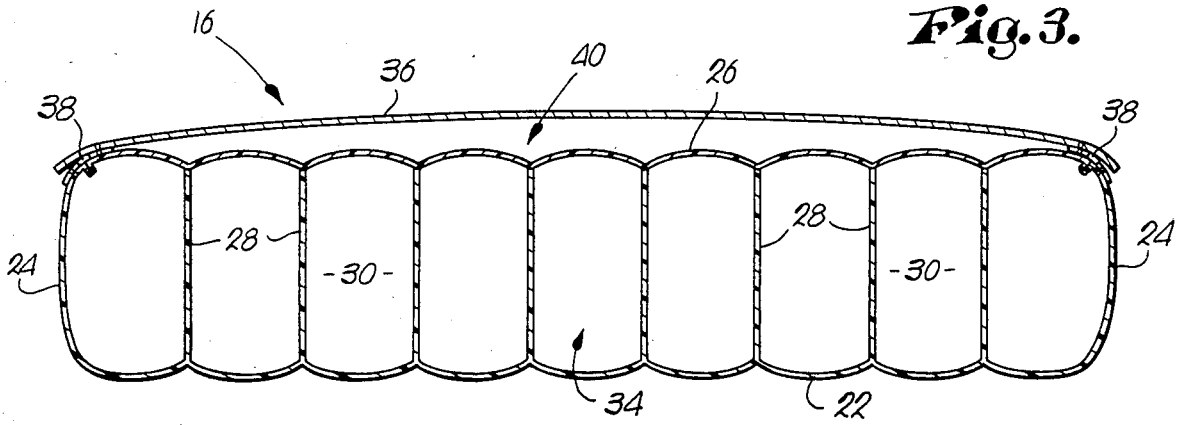

AIR FLOTATION MATTRESS

BACKGROUND OF THE INVENTION

1. Field of the Invention

This invention relates generally to an inflatable mattress, particularly for use in the treatment of patients in hospitals, nursing homes and home care.

2. Description of the Prior Art

Treatment of bedridden patients has long been adversely compounded due to improper support or pressure from the mattress on which the patient rests. Unfortunately, conventional mattresses obstruct both the flow of air to the skin and the dissipation of heat away from the affected area. Additionally, the support provided by such mattresses typically causes much pain to the extremely sensitive and vulnerable areas of the patient's skin.

Another widely known complication resulting from improper mattress support is the development of decubitus ulcers or bedsores. Decubitus ulcers are localized areas of cellular necrosis, or localized death of the skin, which tend to occur between skeletal boney prominances and the compressive mattresses surface upon which the patient rests, such as a mattress. This compressive force, when in excess of the capillary hydrostatic pressure for more than one or two hours, produces tissue ischemia which cannot be compensated by the mechanism of reactive hyperemia. As a result, irreversible pathological destruction occurs in the tissues, leading to death of the latter.

Other physical factors which contribute to production of decubitus ulcers, in addition to the compressive force as hereinabove mentioned, are (1) a shearing force which stretches soft tissue disposed between the bone and a segment of immovabale skin, such that the blood vessels thereby stretched are blocked and in time cause extensive tissue destruction, (2) heat, commonly caused by a fever which increases the metabolic rate of the body and increases the oxygen demand, the supply of which to the skin may already be compromised by the compressive forces, (3) moisture, in the form of perspiration or incontinence, which reduces the resistance of the skin to other physical stresses, (4) friction or abrasion injury which usually results in a loss of epidermis and also may break the integrity of the skin surface such that infection, edema and increased moisture may result, and (5) poor hygiene, wherein bacteria localized in ischemic tissues multiply rapidly and prolong the healing process of the ulcer. Obviously, all such factors are highly dependent upon the characteristics of the mattress or support on which the patient rests.

A variety of mattresses have been proposed in the past in an attempt to provide proper support for a burn victim or patient with decubitus ulcers. Water or gel filled beds, for example, somewhat equalize pressure distribution over the entire body but have no provision for circulating air, removing moisture or dissipating heat from the contacted skin area. Also, the manipulation of the patient on the water bed is difficult, and such beds are extremely heavy and precluded from use in many older buildings.

Several devices have previously been proposed for suspending recumbent patients on a cushion of air such that all contact with a mattress is eliminated. Unfortunately, such devices have not proved to be practical because the high velocity of the rising air column required to support the person tends to damage the healing areas by continual erosion. Additionally, such devices require large amounts of air, expensive pressure regulators and constant adjustment.

Air filled mattresses have also been proposed in the past for use with bedridden patients. U.S. Pat. No. 3,778,851 discloses a mattress having a plurality of somewhat resilient, internal synthetic resin spines, each surrounded by an elongated inflatable rib section which has a plurality of upper airflow apertures. The juxtaposed rib sections are in turn supported by an underlying block of formed plastic material, and the entire assembly is encased in a mattress cover. A continuously flowing airstream inflates the ribs and also escapes through the apertures to cool and ventilate the patient. However, the mattress of the '851 patent does not provide true air flotation support. Rather, the body weight of the patient compresses the rib sections and forces the latter into engagement with the underlying plastic support. As a consequence, the patient is in reality supported by the elongated spines and the lower solid support. It is therefore believed that this mattress construction suffers from many of the aforementioned problems, i.e., it does not provide patient support with the complete absence of substantial weight-supporting internal elements. Moreover, it appears that this mattress construction may inhibit the flow of cool, healing air to the areas of the skin adjacent the mattres and the dissipation of detrimental moisture and heat in all areas of the body.

Accordingly, there is a serious need in the art for a mattress which evenly distributes the weight of the body without the necessity of internal spines or other patient-contacting solid supports. Additionally, the ideal mattress would permit airflow to all areas of the skin to absorb moisture and prevent heat accumulation, yet have a smooth, soft surface and an inexpensive, maintenance-free construction.

SUMMARY OF THE INVENTION

The present invention overcomes the disadvantages of the prior art as discussed hereinabove. The air flotation mattress hereof is operable to support a recumbent patient entirely by means of a throttled flow of pressurized air which also ventilates and cools all adjacent areas of the patient's skin.

In more detail, the mattress has a lower inflatable chamber with a series of side-by-side air supply channels and a flexible, air-permeable nylon upper wall. The apparatus also includes an inflatable compartment overlying the chamber, and for this purpose a secondary wall is operatively coupled with the underlying chamber so that the compartment is defined between the upper wall and secondary wall. The secondary wall (which in effect forms the uppermost wall of the overall mattress apparatus) is advantageously formed of air permeable leather. As air is continuously introduced into the lower chamber, the latter is inflated and the air then passes through the nylon wall to the overlying compartment. As a result, the compartment is also inflated and the air then passes through the upper secondary wall.

Consequently, a person lying atop the secondary wall is supported entirely by the inflatable compartment and chamber without the necessity of spines or other internal, non-inflatable solid support structure within or forming a part of the mattress apparatus. The mattress conforms to the shape of the patient's body such that the reactive pressure presented by the mattress is evenly distributed on all areas of the contacting skin.

The mattress apparatus of the invention provides a means for continuously ventilating all areas of the skin adjacent the mattress, thereby promoting healing. People who may derive substantial benefit from the mattress apparatus include chronically bedridden patients as well as suffering from Multiple Sclerosis, Muscular Dystrophy, Paraplegic, Quadriplegic, Cerebral Palsy, Lupus Erythematosus and Rheumatoid Arthritis. In addition, it is believed that the mattress apparatus will be beneficial for burn victims. Additionally, the healing process for bacterial infection is accelerated as the skin is allowed to "breath." In most cases, the need to turn the patient at periodic intervals is also eliminated.

The utilization of non-buffed leather or suede for the upper secondary wall offers significant advantages. Most leathers are hydrophilic by nature and will wick moisture away from damp skin in the contacted area. As a person's temperature rises and perspiration forms, evaporation of the latter will produce a cooling effect that reduces the buildup of heat. Conversely, the physical structure of leather with numerous microscopic air pockets provides an effective insulative layer for patients requiring maintenance of body temperature. Thus, the preferred leather material functions much in the same manner as normal skin.

The hydrophilic nature of the leathers also advantageously lowers the shear or abrasive resistance of the leather when contacting the skin. Moisture absorbed by the fibers will lubricate the latter internally, allowing them to stretch and readily slide past each other. Such a reduction in friction lowers the probability of abrasive skin injury which otherwise would lead to infection or other complications.

Leather is also widely known for its high tensile strength due to the coil-like molecular strands which interweave and form a large number of interlocks. If a small hole does develop, the interlocks also counteract further tearing in the leather because there is no grain or path of least resistance for a tear to follow. Additionally, the irregular fiber pattern offers a very high resistance to penetration by sharp objects.

Accordingly, the present invention is directed toward an air mattress which is operable both to reduce the incidence of decubitus ulcers and also to promote the healing of preexisting cases of the same. Furthermore, the invention is believed to be useful in treating orthopedic injuries and burn victims in a fashion which is heretofore unknown in the art.

BRIEF DESCRIPTION OF THE DRAWING

FIG. 1 is a perspective view of the mattress apparatus of the invention in use on a bed frame;

FIG. 2 is a fragmentary, enlarged perspective view of the mattress apparatus, with a portion of the upper secondary wall folded back to reveal the upper wall portion; and FIG. 3 is a fragmentary, enlarged side sectional view of the mattress.

DETAILED DESCRIPTION OF THE DRAWING

An air flotation ventilated mattress apparatus is designated broadly by the numeral 10 and is shown in FIG. 1. The apparatus 10 comprises an air pump 12, a channel duct 14 communicating the pump 12 and a mattress 16. The mattress 16 is supported conventionally in horizontal disposition by a bed frame 18 at a height convenient for a patient 20.

Referring to FIG. 3, it will be seen that the mattress 16 includes a substantially air impervious bottom wall 22, as well as a similar, upright, circumscribing continuous sidewall 24. A top wall 26 is connected to the upper end of sidewall 22 as illustrated, and the top wall 26 is of nylon material that is pervious airflow therethrough.

A plurality of upright, laterally spaced apart, flexible baffle walls 28 are situated between the bottom and top walls 22, 26 and extend along the length of the mattress. As best seen in FIG. 3, the respective baffle walls are coupled with the bottom and top walls 22, 26, so as to define a series of discrete, elongated tubes or channels 30 along the length of mattress 16. The baffle walls 28, 30 terminate short of the end portions of sidewall 24, thereby presenting a common manifold section 32 adjacent each end of the mattress 16, which communicates with the channel 30. As will be readily appreciated from a study of FIG. 3, the bottom, side and top walls 22, 24 and 26 cooperatively define a lower inflatable chamber broadly referred to by the numeral 34, with this chamber being divided by the baffle walls into respective channels 30 and manifolds 32 in the manner described.

As indicated, the bottom and sidewalls 22, 24 are substantially impervious to airflow therethrough, and for this purpose a vinyl material can be employed; on the other hand though, the top wall 26 is pervious to the flow of air, and a conventional ripstop nylon material (e.g., that commercialized by Fabri-Quilt of Kansas City) is advantageously used in this context.

The overall mattress 16 further includes a secondary uppermost wall 36 which is operatively coupled to the underlying mattress sub-structure. Specifically, the secondary wall 36 is detachably secured by means of a conventional zipper 38 at a point proximal to the joinder between the sidewall 24 and top wall 26. As seen in FIG. 3, an inflatable compartment 40 is defined between the top wall 26 and secondary wall 36; the importance of this feature will be made clear hereinafter.

In particularly preferred forms of the invention, the secondary wall 36 is formed of a leather material, most advantageously a suede or leather. It has been found that this material gives very even airflow for healing and patient comfort purposes, while nevertheless being extremely sturdy yet soft to the patient's skin.

It will also be observed that the mattress 16 is devoid of any internal solid patient supports which could present areas of pressure contact to a patient lying on the mattress. Rather, only soft, flexible walls are employed in the construction of the mattress 16 which would not, in an of themselves, provide any patient support.

The air pump 12 serves as a means for introducing positive pressure air into mattress 16, and specifically into the chamber 34 as will be explained. In one embodiment of the invention, it has been found that the pump 12 may be housed within a cabinet 42 having an air inlet 44. a Dayton one-half horsepower, 3250 RPM electric motor is situated within the cabinet 42, along with a Dayton 10⅝ inch diameter belt driven blower, Model No. 4C129. The motor has a 3 inch diameter pulley coupled to the output shaft thereof, whereas a 4 inch diameter pulley is secured to the shaft of the blower; a conventional V belt is employed to operatively couple the motor and blower. Cabinet 42 is also provided with an air outlet (not shown) which is located to receive the flow of pressurized air created by the internal blower. The conduit 14, preferably formed of air impervious vinyl material, is connected to the cabinet outlet and is secured to an appropriate air inlet opening provided in an end portion of sidewall 24 (see FIG. 1). As a consequence, it will be readily appreciated that the flow of pressurized air created by the pump 12 is delivered through conduit 14 into the chamber 34 of mattress 16.

In operation, the mattress 16 is placed on bed frame 18, and the air pump 12 is coupled to the mattress 16 by means of the conduit 14. At this point, the air pump is activated so as to create a pressurized stream of air which is directed into the internal chamber 34 of the mattress 16. In this connection, such air first enters the adjacent manifold 32, and thence travels through the respective channels 30, so as to inflate the entire chamber 34. Inasmuch as the bottom wall 22 and sidewall 24 are substantially impervious to airflow, whereas top wall 26 is air pervious, it will be readily appreciated that pressurized air passes evenly through virtually the entire plan surface area of the top wall 26. As a consequence, such air also serves to inflate the upper compartment 40 between top wall 26 and secondary wall 36. Such pressurized air then flows evenly through the suede or leather secondary wall 36; here again, this airflow is substantially even over substantially the entire plan surface area of the wall 36.

When a patient 20 is placed on the mattress 16, his entire weight is supported by the flow of pressurized air through the mattress structure. As will be readily appreciated from the foregoing discussion, the overall mattress apparatus includes no solid internal patient supports, and therefore no potentially troublesome pressure areas are maintained against the patient's skin. At the same time however, the constant flow of air through the walls 26, 36, creates a highly desirable condition conductive to skin healing. It will of course be understood that if desired the air from pump 12 can be heated to a desired temperature for enhanced patient comfort. As another alternative, medicament could be injected into the airflow for passage through the mattress apparatus and into contact with the patient's skin. Finally, the flexible nature of the mattress apparatus ensure that it can be used on conventional, adjustable height hospital beds, and that no impediments are created to normal patient handling or treatment by hospital personnel.

The cooperative configuration and arrangement of the pump 12 and the mattress 16, particularly the proper permeability of the walls 26, 36, thus present a mattress apparatus 10 which can readily support the patient 20 without the necessity of additional weight supporting means such as foamed spines or other additional structure placed within the tubes 22 or the compartment 34. The entire weight of the patient 20 is carried exclusively by the inflatable chamber 28 and compartment 34. Such construction is particularly advantageous because no solid support structure is used which otherwise would press against highly sensitive skin. In effect, the walls 26, 36 properly throttle or restrict the flow of pressurized air through the mattress 16 to achieve the desirable results of the invention.

As explained hereinabove, the leather secondary wall 32 is moisture absorbent such that the skin of the patient 20 can "breathe." Also, the removed, excess moisture simultaneously lubricates the internal fibers of the secondary wall 32. The mattresses 16 therefore minimizes shear or abrasive injury to the skin and also helps prevent decubitus ulcers in patients having chronic diseases or disablements.

In case of accidental loss of power or pump failure, the patient 20 will simply glide downwardly until at rest on the underlying bed frame 18.

While many other advantageous utilizations of the instant invention may be quite readily perceived, it is to be understood that the invention should be limited only by the fair scope of the claims which follow, when the latter are reasonably interpreted to encompass manifest mechanical equivalents.

We claim:

1. An air flotation, ventilated mattress apparatus comprising:

means defining a lower, continuous, inflatable chamber having an air-permeable, flexible upper wall portion, said upper wall portion being constructed for substantially uniform airflow therethrough over substantially the entire plan surface area of said upper wall portion;

air-permeable secondary wall means above said chamber upper wall portion and operably coupled with said chamber-defining means, said secondary wall means being constructed for substantially uniform passage of air therethrough over substantially the entire plan surface area of said secondary wall means, said secondary wall means and upper wall cooperatively defining therebetween an inflatable compartment above said chamber; and means for continuously introducing positive pressure air into said chamber in order to continuously maintain positive air pressure conditions throughout the entirety of said chamber during the entirety of operation of said mattress apparatus and to inflate both said chamber and compartment by passage of said air into said chamber and thence through said upper wall portion and thereby maintain positive air pressure conditions in said compartment, and to cause said continuous passage of air through said secondary wall means, said mattress apparatus being free of solid internal support structure for supporting a patient, said air introduction means, upper wall portion and secondary wall means being cooperatively configured and arranged for continuous passage of sufficient positive pressure airflow through the chamber, upper wall portion, compartment, and secondary wall means for even, substantially uniform flow of air from said mattress apparatus so that a person lying atop the secondary wall means is supported by said pressurized air without the presence of weight-supporting structure within said mattress apparatus.

2. The invention of claim 1, said secondary wall means being sufficiently hydrophilic to dissipate moisture from the skin of a person lying atop said secondary wall portion.

3. The invention of claim 2, said secondary wall means being selectively detachable from said chamber-defining means.

4. The invention of claim 1, said lower chamber comprising a plurality of elongated, side-by-side channels separated by laterally spaced apart, upright flexible baffle walls.

5. The invention of claim 4, said chamber also having a pair of end manifolds, said manifolds communicating with with said channels.

6. The invention of claim 1, said upper wall portion being comprised of nylon material.

7. The invention of claim 1, said secondary wall means comprising a sheet of air pervious leather material.

8. The invention of claim 7, said leather being nonbuffed.

9. The invention of claim 7, said leather being suede.

* * * * *